United States Patent [19]

Griffith

[11] 4,011,347

[45] Mar. 8, 1977

[54] FOOD PRODUCT CONTAINING CUSHIONING MEANS

[75] Inventor: Edwin D. Griffith, Pemberville, Ohio

[73] Assignee: Owens-Illinois, Inc., Toledo, Ohio

[22] Filed: May 12, 1975

[21] Appl. No.: 576,525

[52] U.S. Cl. ..... 426/124; 206/523; 229/14 C

[51] Int. Cl.[2] ..... B65D 85/30

[58] Field of Search ..... 426/124, 128, 119, 106; 229/14 C; 220/68; 206/523, 521, 499; 217/265, 27

[56] References Cited

UNITED STATES PATENTS

| | | | |
|---|---|---|---|
| 1,042,928 | 10/1912 | Kopf | 229/14 C |
| 1,808,136 | 6/1931 | Gray | 229/14 C |
| 1,868,996 | 7/1932 | Sharp | 426/298 |
| 2,458,737 | 1/1949 | Salkowitz | 229/14 C |
| 2,675,319 | 4/1954 | Schwartzberg | 426/119 |
| 2,808,189 | 10/1957 | Williams | 229/14 C |
| 3,018,015 | 1/1962 | Agriss et al. | 206/521 |
| 3,146,112 | 8/1964 | Weinstein | 426/124 |
| 3,498,798 | 3/1970 | Baur et al. | 426/124 |
| 3,516,538 | 6/1970 | Van Antwerpen | 229/14 C |
| 3,740,238 | 6/1973 | Graham | 426/124 |
| 3,745,025 | 7/1973 | Hollinger | 426/124 |
| 3,752,384 | 8/1973 | Siburn | 229/14 C |
| 3,782,621 | 1/1974 | Edgeington et al. | 229/14 C |
| 3,821,426 | 6/1974 | Slone | 426/124 X |
| 3,853,221 | 12/1974 | Boyd | 229/14 C X |
| 3,890,762 | 6/1975 | Ernst et al. | 229/14 C |

OTHER PUBLICATIONS

Modern Mat'ls Handling, 11/56, pp. 90, 91.

*Primary Examiner*—Steven L. Weinstein
*Attorney, Agent, or Firm*—A. J. Steger; E. J. Holler

[57] ABSTRACT

Food cushioning means are provided to cushion and protect a stack of uniformly-shaped units of food product, such as chips, crackers, or cookies, that are shipped in a cylindrical container. A unique, inverted, cup-shaped bottom cushioning member is provided to support and cushion the stack of food product from the bottom. A sleeve of corrugated foam plastic is utilized to surround and cushion the sides of the stack of food product. In another embodiment, the invention provides an integral bottom and side cushioning member, which comprises a unique corrugated foam sleeve with a pair of tab portions folded inwardly near the bottom of the sleeve to support the stack of food product from the bottom.

3 Claims, 10 Drawing Figures

FOOD PRODUCT CONTAINING CUSHIONING MEANS

BACKGROUND OF THE INVENTION

This invention relates to packaging of food products and, more particularly, it relates to a package for food products that are shipped in a stacked array which incorporates unique cushioning means to cushion the stack of food products both along the sides and from the bottom. A cylindrical container of the type disclosed in U.S. Pat. No. 3,498,798 (F. J. Baur et al.) has been used increasingly to package potato chips and other chip-type snack food products. In such a package, the chips are formed with a uniform size and shape and stacked upon each other within the cylindrical container. The Baur et al. patent utilizes a corrugated single face glassine sleeve which is inserted within the container to surround and cushion the chips contained therein. It has been found, however, that the use of a corrugated single face glassine cushioning member around only the sides of the chips has not been sufficient to prevent substantial breakage of the chips during shipping and handling, particularly when the container is subjected to bottom impact.

SUMMARY OF THE INVENTION

It is, therefore, an object of this invention to provide food cushioning means which will successfully cushion and protect a stack of uniformly-shaped units of food product against breakage during shipping and handling. A unique, inverted, cup-shaped bottom cushioning member is provided to support and cushion the stack of food product from the bottom. This bottom cushioning member may be combined with a cylindrical-shaped, corrugated foam sleeve which is used to surround the stack of food product along the sides thereof. In another embodiment, the invention provides an integral bottom and side cushioning member which comprises a unique cylindrical corrugated foam sleeve with a pair of tab portions folded inwardly near the bottom of the sleeve to support the stack of food products contained therein. The unique food cushioning devices of this invention are particularly suited to be utilized with the previously described package for shipping a stack of potato chips or other chip-type food product in a cylindrical container.

Other objects, features and advantages of the subject invention will become apparent upon reference to the following detailed description of the invention and the drawings illustrating the preferred embodiments thereof.

IN THE DRAWINGS

DESCRIPTION OF THE PREFERRED EMBODIMENTS

Figure 1:
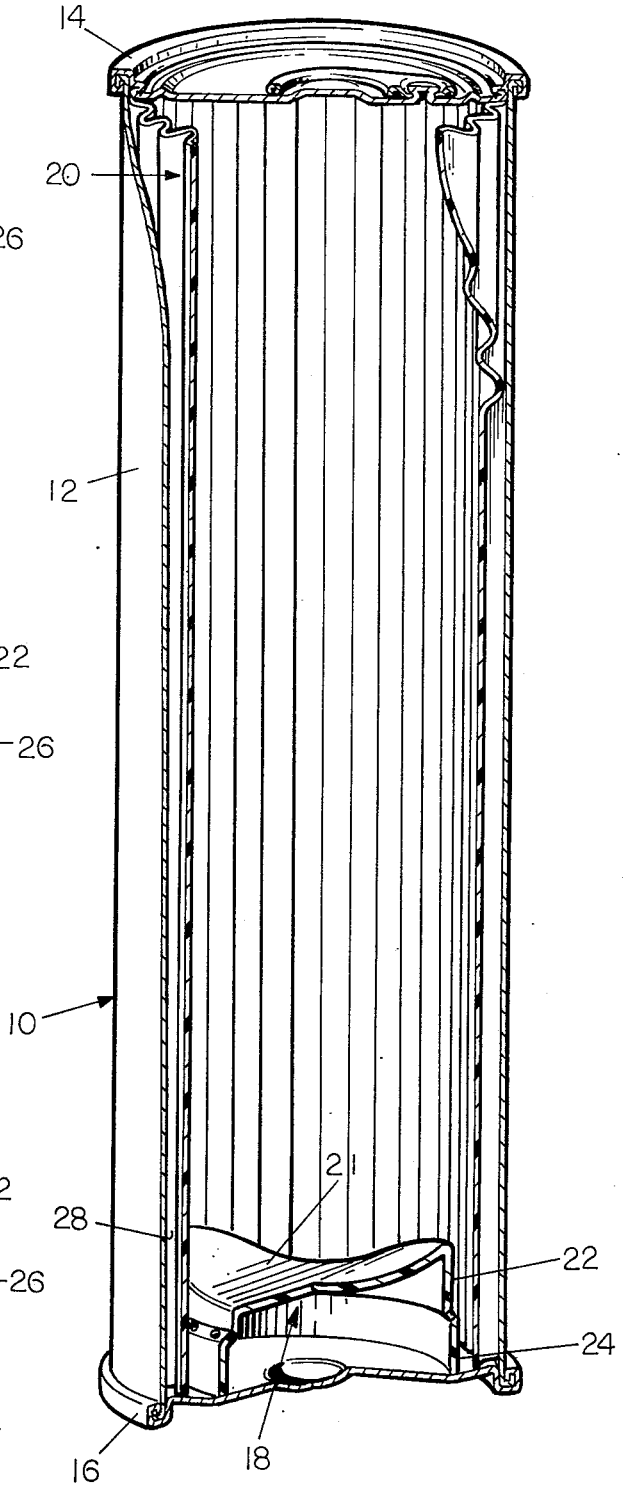
FIG. 1 is a perspective view, with parts broken away in section, of a cylindrical container incorporating both an inverted, cup-shaped bottom cushioning member and a corrugated foam side cushioning sleeve in accordance with this invention.
Figure 5:
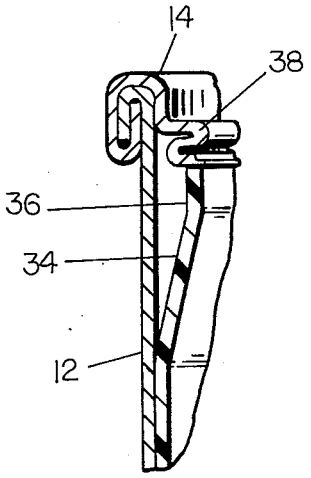
FIG. 5 is a partial, sectional view of an alternate embodiment of the side cushioning sleeve, as taught by this invention.
Figure 6:
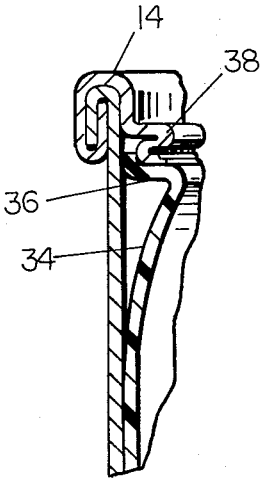
FIG. 6 is another alternate embodiment of the side cushioning sleeve of this invention.
Figure 4:
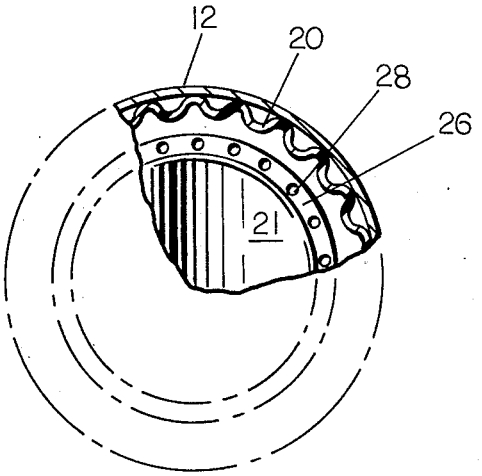
FIG. 4 is a sectional view, with parts broken away, of the container of FIG. 1.

A suitable cylindrical container, indicated generally by the numeral 10 in FIG. 1, includes a cylindrical can body 12 and a pair of metal ends 14 and 16. The can body 12 may be formed from any suitable container material, which is impervious to the passage of oxygen, such as a metal or composite structure. The use of a composite structure, which is formed from various layers of fibrous material, has become quite popular in the packaging of snack food products, primarily due to its relatively low cost. The metal ends 14 and 16 may be attached to the can body 12 by any suitable method, such as the standard double seaming method. In the double seaming method, an upper margin of the can body is folded into overlapping engagement with a flanged portion of the can end, as shown in FIGS. 5 and 6. As taught by the previously described patent to Baur et al., the cylindrical container 10 is well suited for packaging of potato chips or other chip-type snack food products by stacking the chips in a uniform stack within the container.

Figure 2:
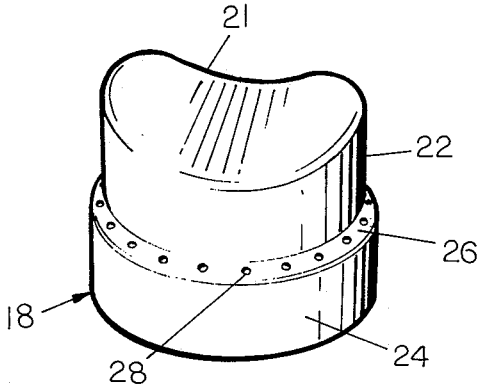
FIG. 2 is a perspective view of a bottom cushioning member of FIG. 1.
Figure 3:
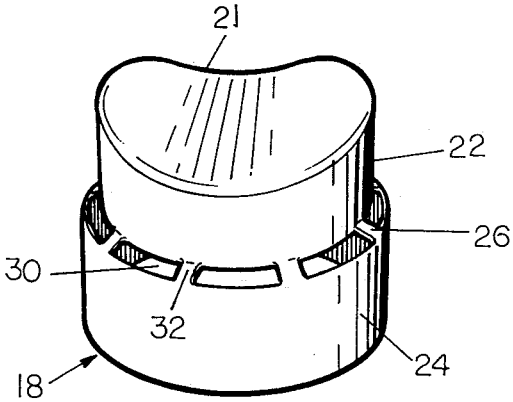
FIG. 3 is an alternate embodiment of the bottom cushioning member disclosed in FIG. 2.
Figure 3A:
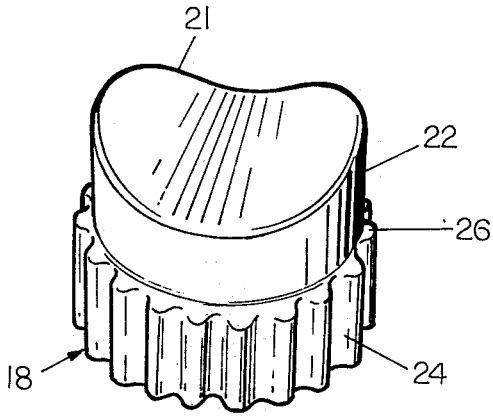
FIG. 3A is another alternate embodiment of the bottom cushioning member.

Chip cushioning means, as taught by this invention, include a bottom cushioning device, indicated generally by the numeral 18, and a side cushioning sleeve, indicated generally by the numeral 20. The bottom cushioning member may be constructed in a variety of shapes, several of which are shown in FIGS. 2, 3 and 3A. In these examples, the bottom cushioning member is of a generally inverted, cup-shaped configuration and incorporates a top panel 21 and an upper annular sidewall 22 separated from a lower annular sidewall 24 by means of a connecting ledge 26. The connecting ledge 26 may take the form of a continuous member with holes 28 formed therein, as shown in FIG. 2. The holes 28 allow for passage of gas during an inert gas flushing operation which may be utilized to purge oxygen from within the container 10. The connecting ledge 26 also could take the shape shown in FIG. 3, wherein large rectangular openings 30 are separated by connecting bridges 32. The rectangular openings 30 allow for the flow of gas, as described in connection with openings 28, while the bridges 32 provide a resilient connection between upper and lower annular walls 22 and 24. In FIG. 3A, the connecting ledge 26 is a continuous member, and the lower annular sidewall 24 is fluted or corrugated to provide resilience to the bottom cushioning member. It should be noted that the top panel 21 of the bottom cushioning member 18 may be shaped to conform to the configuration of the particular product being packaged. For example, the top panel 21 could be contoured for chip-type products or flat for crackers and cookies. It also may be embossed, ribbed, or dimpled to facilitate product positioning. It is suggested that the bottom cushioning member 18 be thermoformed from a thin, plastic sheet, such as 10 mil polystyrene, so that it is both inexpensive and sufficiently resilient to provide a cushioning effect for the stack of chips that are placed thereon.

The side cushioning sleeve 20 may be formed from a corrugated foam plastic material, such as polystyrene or polyethylene and is inserted within the container to surround the stack of chips along its sides. It is suggested that the corrugated foam sleeve could be formed from a .012–.017 inch foamed polystyrene sheet to provide successful cushioning of the chips. Such a corrugated foam sleeve will be easier to fabricate and considerably less expensive than the corrugated single face paper or glassine sleeves used heretofore.

If it is desired to use a foam liner that is not corrugated, it is suggested that the liner be formed into an integral sleeve with a heat-sealed overlapping seam with the upper margin of the foam liner formed in accordance with the configurations shown in FIGS. 5 and 6. A noncorrugated foam liner 34 is illustrated with an inwardly tapered upper flange portion 36. The flange portion 36 in FIG. 5 terminates adjacent a protective bead 38 which remains with the container when the top panel has been removed therefrom. In FIG. 6, the upper flange 36 is reversely bent outwardly so that it resides behind the protective bead 38 on the can end 14. In each of these cases, the inward flare of the flange portion 36 is sufficient to provide easy removal of the food product from the container without damaging the product on the bead 38. It should be noted that when a corrugated side cushioning member is utilized, the innermost circumference of the cushioning member resides inwardly of the bead member 38 to protect the snack product during removal without the necessity of flaring the upper end of the cushioning member.

Thus, the combination of the bottom cushioning device 18 and a corrugated foam side cushioning sleeve 20 provides a complete cushioning system for a stack of food product within the container 12. It should be understood that, while bottom cushioning device 18 and side cushioning sleeve 20 may be used separately, their combination results in more effective cushioning for the units of food product.

Figure 7:
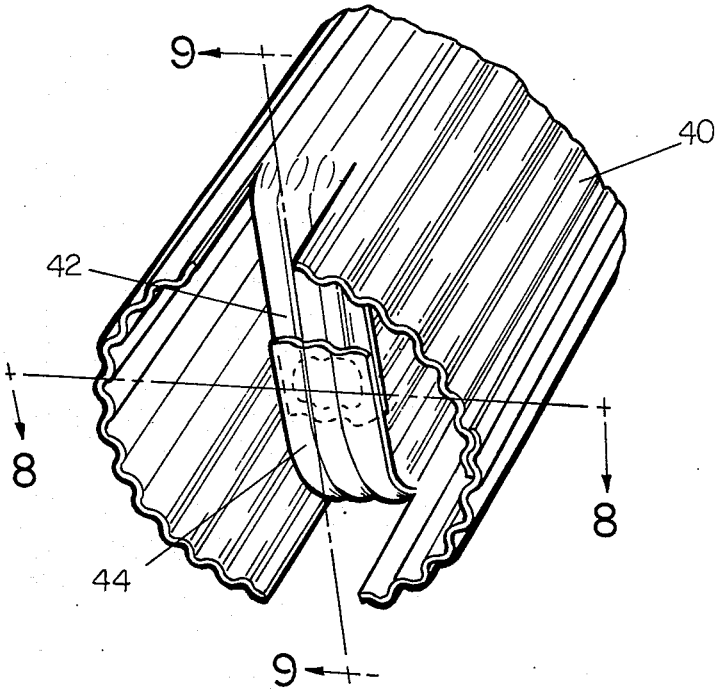
FIG. 7 is a partial, perspective view of an alternate embodiment of this invention which provides an integral side and bottom cushioning member.
Figure 8:
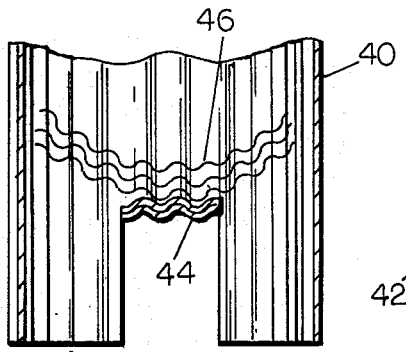
FIG. 8 is a sectional view of the integral side and bottom cushioning member of FIG. 7.
Figure 9:
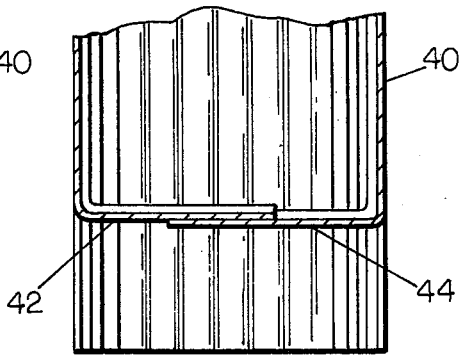
FIG. 9 is another sectional view of the integral side and bottom cushioning member of FIG. 7.

An alternate embodiment is illustrated in FIGS. 7–9 and discloses a one-piece cushioning device which is adapted to provide both bottom and side cushioning for a stack of food product. A corrugated foam member 40 is formed in the shape of a cylindrical sleeve. A pair of inwardly bent, overlapping tab portions 42 and 44 is formed near the bottom of the sidewalls of the cylindrical cushioning sleeve 40. These overlapping tab portions 42 and 44 are then attached to each other, either through the application of an adhesive or the application of heat, to form a bottom cushioning member for the stack of food product. The function of the overlapping tab members 42 and 44 can be seen in the sectional views in FIGS. 8 and 9, wherein a stack of food product, such as chips 46, is being supported by these overlapping tab members. Thus, the configuration disclosed in FIGS. 7–9 provides an integral, one-piece bottom and side cushioning member for a stack of uniformly-shaped chips. The one-piece, integral cushioning member of FIGS. 7–9, as formed from foamed plastic material, would provide both side and bottom cushioning at a considerably lower cost than would the corrugated single face glassine side cushioning member taught by the prior art.

In a commercial operation, the foam plastic material, such as polystyrene or polyethylene, would be fed from a roll, corrugated between suitable corrugating rolls, formed into a cylinder of the desired design and inserted into a can in one operation by a single machine. The stack of food product, such as chips, crackers, or cookies, would then be put into the can and the second end seamed into engagement with the can body.

I claim:

1. A package containing a stack of uniformly-shaped individual units of food product and a food product cushioning means, said package comprising, in combination:

a substantially rigid tubular container surrounding said stack of uniformly-shaped individual units of food product, said container having a sidewall formed from a substantially oxygen-impervious material having ends secured thereto; and a resilient cushioning means positioned within said container supporting the bottom of said stack of uniformly-shaped individual units of food product, said resilient cushioning means being adapted to prevent breakage of said individual food units and including a circular top wall having a contour approximating the contour of the uniformly-shaped units of food product in said stack, a first annular sidewall depending downwardly from the outer extremities of said circular top wall, a flexible connecting ledge extending outwardly from the bottom edge of said first annular sidewall, and a second annular sidewall of greater diameter than said first annular sidewall depending downwardly from the outer extremity of said flexible connecting ledge.

2. A package as set forth in claim 1, wherein said flexible connecting ledge includes a plurality of apertures formed therein to facilitate the flow of gas through said container.

3. A package as set forth in claim 1, wherein said flexible connecting ledge includes a plurality of bridges connecting the bottom edge of said first annular sidewall to the upper edge of said second annular sidewall, said bridges being separated by rectangular openings which facilitate the flow of gas through said container.

* * * * *